US005454636A

United States Patent [19]

Taub

[11] Patent Number: 5,454,636

[45] Date of Patent: Oct. 3, 1995

[54] ARTICULATED DESK ASSEMBLY WITH ENHANCED STORAGE CAPABILITIES

[76] Inventor: Ronald H. Taub, 980 N. Michigan Ave., Chicago, Ill. 60611

[21] Appl. No.: 195,292

[22] Filed: Feb. 14, 1994

[51] Int. Cl.[6] ..... A47B 17/06

[52] U.S. Cl. ..... 312/196; 312/282; 108/94

[58] Field of Search ..... 312/326, 196, 312/197, 282, 317.3; 108/94

[56] References Cited

U.S. PATENT DOCUMENTS

| | | | |
|---|---|---|---|
| 1,606,874 | 11/1926 | Gorczynski | 108/94 |
| 2,988,413 | 6/1961 | Bergen | 312/282 |
| 3,239,294 | 3/1966 | Lammeyer | 312/282 |
| 4,709,971 | 12/1987 | Leeds et al. | 312/282 |

FOREIGN PATENT DOCUMENTS

| | | | |
|---|---|---|---|
| 0586830 | 10/1933 | Germany | 312/282 |
| 0255366 | 6/1948 | Switzerland | 312/326 |

*Primary Examiner*—Kenneth J. Dorner
*Assistant Examiner*—Gerald A. Anderson
*Attorney, Agent, or Firm*—Michael G. Berkman

[57] ABSTRACT

A combination storage cabinet and L-shaped work station assembly. The assembly includes a base having a top work surface. An arcuately-swingable, pedestal-mounted top is supported above, overlies and is spaced upwardly of the top surface of the cabinet. In a second position, the top is pivotally displaced about a fixed vertical axis to extend outwardly in a horizontal plane and normally of a principal horizontal axis of the cabinet to expose the top work surface of the cabinet and to form, with the cabinet, an L-shaped work station. Walls depend skirt-like from two adjacent edges of the top to define a visual screen for hiding from view office components which may conveniently be allowed to remain in place on the top work surface of the cabinet when the assembly is in a closed mode.

10 Claims, 3 Drawing Sheets

ARTICULATED DESK ASSEMBLY WITH ENHANCED STORAGE CAPABILITIES

BACKGROUND AND FIELD OF THE INVENTION

The present invention relates to a convertible article of furniture for home or for office use. More particularly, the invention is directed to a storage cabinet readily and conveniently transformable to a desk.

Known in the art are furniture items such as chests or cabinets which may be transformed into desks or work stations. Included among these are structures in which a secondary top which overlies a base, cabinet, or chest may be pivoted horizontally from its reference position, to extend normally of or at some other angle from a base or primary structure. In some prior art arrangements a board, plank, or leaf sandwiched between the top of a table and the table body is pulled outwardly along guide rails and then pivoted to extend transversely of the supporting base. In other arrangements an auxiliary shelf or work surface pivotally attached to a desk and supported on independent legs is stored or stowed in a kneehole zone of a desk.

In yet other arrangements, a table top is fastened at one end to the body of a chest. The top has a pair of support legs or a or a supporting wall depending from its opposite end and is pivotal to project from the chest to provide a work surface. In some articles the pivotal or extending top assumes a storage portion beneath the desk top. In others 1 it closely overlies the desk top. Work stations which consist of laterally pivotal, interesting body sections which open to provide access to shelves and cabinet chambers for housing and storing computer components such as terminals, display screens and related information recording and processing apparatus including key boards, printers and other electronic equipment are also known.

However, the convenience and utility of known desk assemblies of the class having a fixed work surface as well as an auxiliary, second work top in which the latter may be manipulated between a stand-by or a storage mode and a functional disposition are somewhat limited. In most cases there is absent a capability of utilizing, simultaneously both the top of the desk or cabinet as well as the top surface of the secondary work-top component, when the secondary work top or panel is in a mode to overlie the desk or base. The work surface of the desk is rendered totally unavailable for useful purposes. Reversal of the physical arrangement ordinarily creates a similar problem.

Many of the known "convertible" desk structures are undesirably complex in operation as well as in their physical structures, whether a secondary top is slidable or is pivoted. In still others, either the desk top or the auxiliary top, or both, must be cleared off before the assembly can be converted to its consolidated, or compacted, or compressed modal configuration.

For the most part the convertible assemblies of the prior art are lacking in either aesthetic or artistic appeal. They are intended for use solely or primarily in business or commercial environments, rather than in homes or in home office areas or dens.

For the most part, known assemblies which utilize secondary or auxiliary work tops do not allow one's use of the table top or desk top itself as a permanent locus for the placement and for the use, as well as for out-of-sight storage of "desk-top" devices machines, and other articles. Inconveniently, such items must be removed and then stored elsewhere when an auxiliary or second work top is relegated to an "at ready" or standby modal disposition. In this disposition, the second work top is more or less in a real congruence or in superimposed registry with a top work surface of a desk or table, the desk itself being the principal component of the assembly. Vertical spacing between the desk top and the second work panel is ordinarily quite restricted. Either the desk top or the top of the auxiliary work surface must be cleared, depending on which constitutes the undermost unit. Usually, this is the desk top.

While convertible assemblies involving desks and their physical conversion to space-enhancing and more versatile work stations are known, each structure has one or more objectionable features. Each suffers from one or more inadequacies. It is, accordingly, a principal aim of the present invention to provide an articulate desk assembly constituting a base or cabinet-like structure which may simply and expeditiously be converted to a desk having a significantly increased top span or useful work surface, a preserved storage space, and which cures many of the objectionable features and shortcomings of prior art structures.

SUMMARY OF THE INVENTION

In accordance with the present invention there is provided a cabinet-like base or desk unit in combination with an arcuately swingable, auxiliary or secondary work top. The secondary top, secured to and pivotally mounted on the base cabinet, may be readily articulated to extend, in a cantilevered configuration outwardly and generally normally of a principal horizontal axis of the base unit.

It is an important feature of the assembly of the present invention that the pivotal auxiliary top which, in a stand-by mode, overlies the top or work surface of the base cabinet or desk body, is spaced upwardly of the top surface of the base a substantial vertical distance or height.

A related and exceedingly significant feature of the invention is that there is provided a substantial vertical spacing of the pivotal top or auxiliary work panel upwardly of the top surface of the cabinet. This allows one to swing the pivotal top to a position in which it overlies the base unit of the assembly without any need first to remove articles one wishes to retain undisturbed on the top or work surface of the base unit component of the assembly.

A feature of the desk assembly of the invention is that one end of the base unit or cabinet of the assembly is provided with an upwardly projecting pedestal to which a turntable is attached and to which the pivotable top panel is anchored. Accordingly, the pivotal top is displaced upwardly of the top surface or work surface of the base unit or cabinet of the assembly.

A related feature of the invention, contributing to its aesthetic appeal, is that the elevated pivotal top is provided at its forward edge and along its opposite end, which is anchored on the pedestal, with a depending skirt extending to a top surface of the base unit or cabinet of the assembly. In this way the top work surface of the base unit and the articles stored thereon are effectively shielded from view.

A cooperating structural feature of the cabinet or base of the assembly is a fragmentary back wall extending upwardly of the base to abut the rear edge of the pivotal top member of the assembly when the latter overlies the base unit.

In a preferred embodiment of the invention skirt-like wall sections depending from the pivotal top of the assembly, in combination with an upstanding rear wall sector projecting upward from the top of the base or cabinet, effectively shield from view articles which may be stored or left on the work surface of the base of the assembly when the assembly assumes a closed configuration.

Other features of preferred embodiments of the invention are that the base or cabinet of the assembly is formed with storage compartments and with drawers conveniently accessible from the front and from each end of the base unit.

A related feature of the invention is that doors opening upon the drawers and the storage compartments are faced with or are paneled with decorative coverings, for example, grass cloth.

Yet another feature of the combination storage cabinet, desk, and work station of the invention is the provision of through passageways or openings formed in a rear upstanding wall of the base cabinet to facilitate the feeding of cables or electric coeds therethough for delivering electrical power to word processors, computer components and other devices supported and stored on the work surface of the base cabinet.

In accordance with the present invention there is provided a baselike cabinet or chest having the appearance and the utility of a space-conserving, decorative and useful article of furniture readily compatible with other well designed household furnishings.

The assembly of the present invention is quickly and easily transformable into a versatile work station merely by swinging a pivotally mounted top panel of the assembly to extend at right angles to the base in a cantilevered mode.

An important feature of the invention is that the attachment of the pivotal panel or work top to a turn table, which is in turn secured to a base-mounted pedestal at an end of the chest or base cabinet, is that attachment and securement are exceedingly strong and firm obviating any need to provide any auxiliary support at the opposite end of the pivotal work top, even when the latter extends outwardly of the base and normally thereto.

In one preferred embodiment of the invention the pivoting top or panel is formed, at its end secured to the base, with a curved end.

A feature of the present invention is the provision of depending skirts along the front and an end of the pivotal top, and an auxiliary wall segment extending upwardly of the base cabinet at a rear edge thereof to enclose the spatial volume between a top work surface of the base cabinet and an under-surface of the pivotal top when the assembly is in a closed configuration. All items allowed to remain on the base cabinet are completely shielded from view.

Other and further objects, features and advantages of the present invention will be evident upon a reading of the following specifications and upon consideration of the drawings.

DETAILED DESCRIPTION OF ILLUSTRATED EMBODIMENT

The aims and objects, and a realization of its advantages are achieved in accordance with the present invention, through the engineering and design of a novel, convertible, multi-functional furniture assembly.

One component of the assembly takes the form of a base unit or cabinet fitted with desk-type drawers, storage compartments, and filing drawers. The cabinet has a top or top work surface on which office equipment and related articles are arranged for use as required, as well as for convenient storage when not in use.

A second component of the assembly of the invention is a top or panel pivotally secured to and supported on a raised pedestal surmounting the top or work surface of the cabinet at one end thereof. A turn table is interposed between and couples the cabinet to the pivotal top. The arrangement described enables one to swing the top or panel from a first position in which the top overlies the base cabinet, to a second position in which the top or panel swings outwardly from the base cabinet to extend generally normally thereof, thus providing an L-shaped work station. In the resulting structural configuration two distinct work surfaces are generated. The first is the top of the base unit or cabinet; the second consists of the exposed top surface of the swingable top or panel. Both work surfaces are readily accessible to one seated at the assembly and facing the elongate side edge of the projecting panel.

The invention is further characterized in that the swingable top or panel has cantilevered to extend from the base cabinet and that there is no need for an auxiliary leg or wall to support the free end of the projecting panel. In a closed configuration of the assembly, there is established an enclosed chamber in which items and articles conveniently left on the top or work surface of the base cabinet are hidden and shielded from view.

Figure 1:
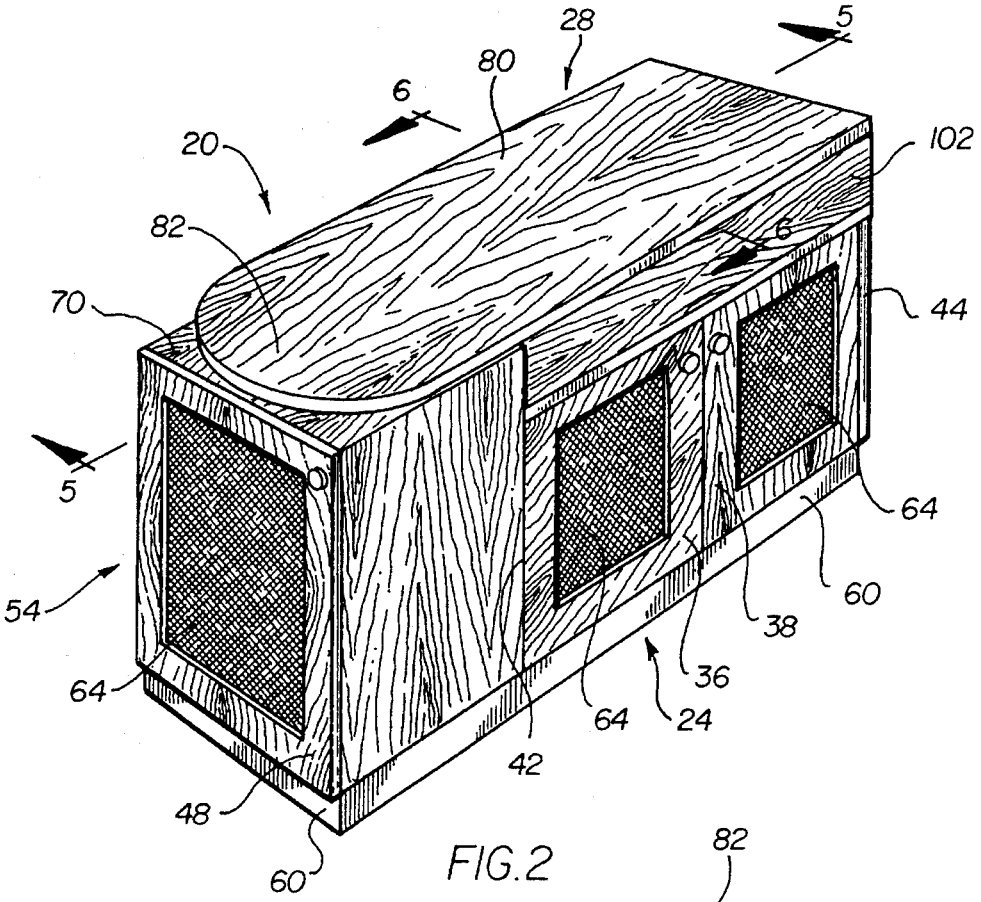
FIG. 1 is a frontal perspective view of the desk assembly of the invention in a closed configuration, and showing the front and one end of the base and the pivotal top.
Figure 2:
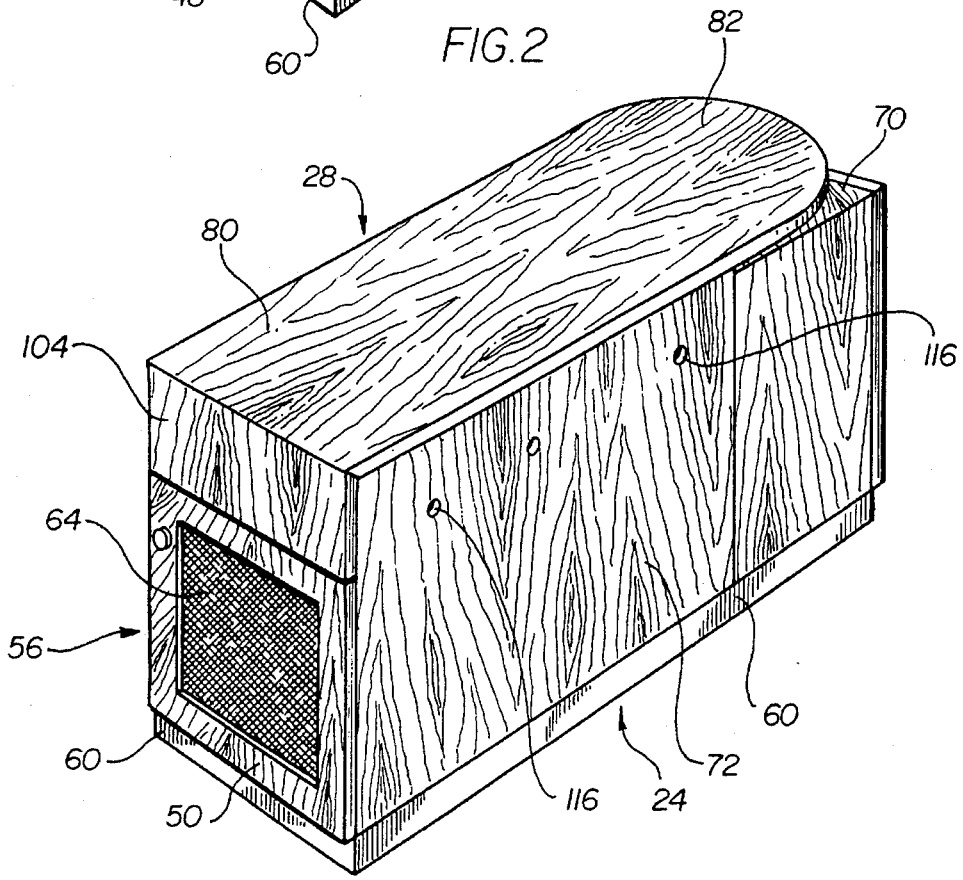
FIG. 2 is a rear perspective view of the desk assembly of FIG. 1, and showing the rear and an opposite end of the assembly.
Figure 3:
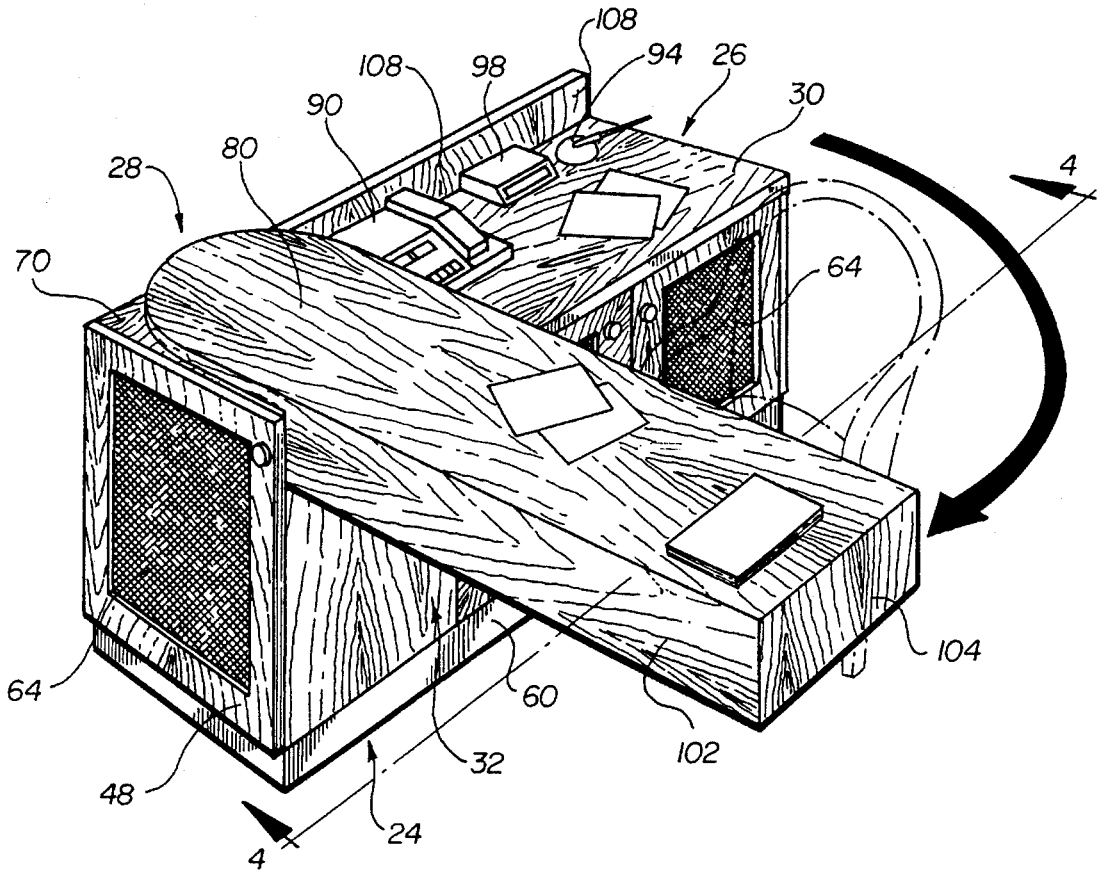
FIG. 3 is a perspective view of the desk assembly of the invention, as shown in FIG. 1, but with the cantilevered, pivotally secured, overlying top oriented to extend normally of the base of the desk and outwardly therefrom, and showing, schematically, the position of a desk chair in a functional orientation or attitude.

Referring now to the drawings, and more particularly to FIGS. 1, 2 and 3, for purposes of illustrative disclosure and not in any limiting sense, a preferred embodiment of the invention is shown as an assembly 20 consisting of a base, storage cabinet or desk unit 24 and a pivotally-secured, surmounting top or top panel 28. The assembly is shown in FIGS. 1 and 2 in a closed or compacted configuration. In FIG. 3 the assembly 20 is shown with the base-surmounting top 28 pivoted outwardly of an end of the base cabinet 24 to project generally normally of a principal horizontal axis of the cabinet 24.

In the embodiment of the invention shown, the cabinet 24 is an elongate, block-like structure rectangular in transverse section. The top 26 of the cabinet 24 presents a planar work surface 30 over its major expanse (FIG. 3). A front wall 32 of the base cabinet 24 is fitted with doors 36 and 38 hingedly supported at their outer lateral ends 42 and 44 to provide access to the interior of the cabinet 24 when storage space is provided in the form of drawers, filing drawers and/or open shelving. Alternatively, the doors 36 and 38 may be slidably mounted for lateral movement. Hinged doors 48 and 50 at opposed endwalls 54 and 56 provide access to interior storage compartments within the desk base 24. In a preferred embodiment of the invention the doors are faced with decorative grasscloth 64. At a lower perimetric zone 60 the base cabinet 24 is recessed 60.

Figure 4:
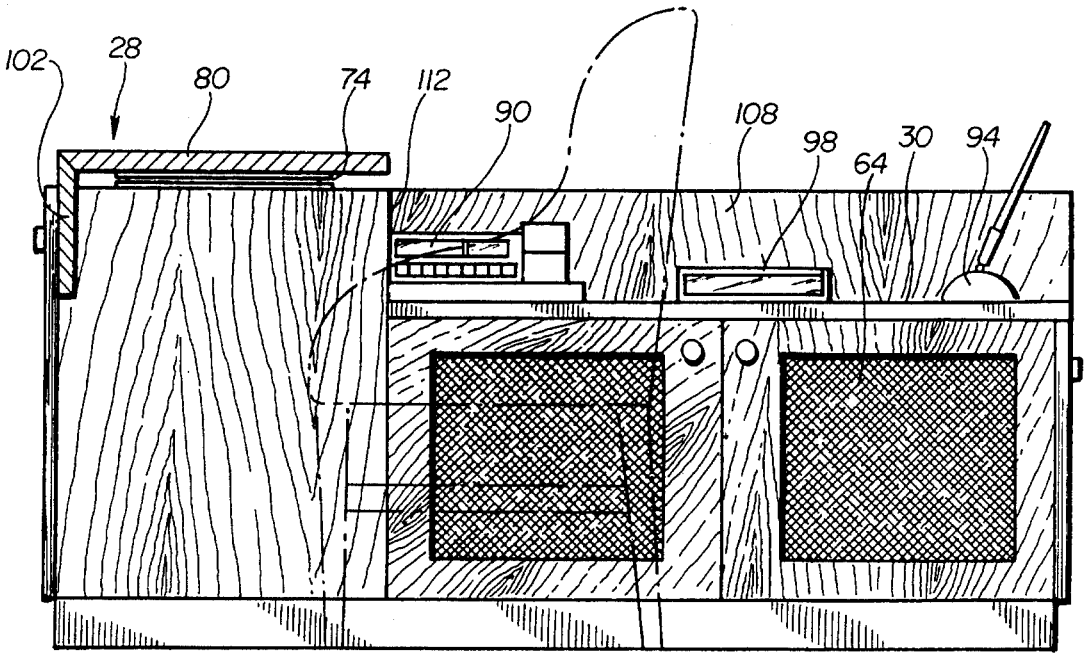
FIG. 4 is a front elevational view of an articulated desk assembly according to the invention, and in an open configuration.
Figure 5:
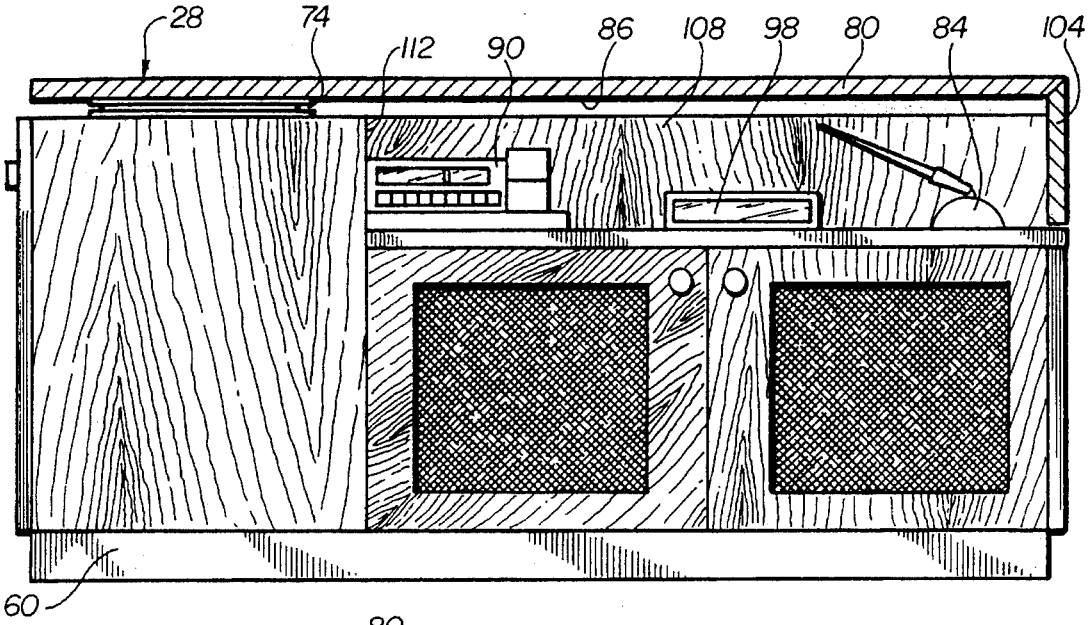
FIG. 5 is a cross-sectional view of the assembly of the invention taken substantially on the lines 5—5 of FIG. 1 and showing desk articles stored on the desk top and undisturbed by the pivotable, secondary work top.
Figure 6A:
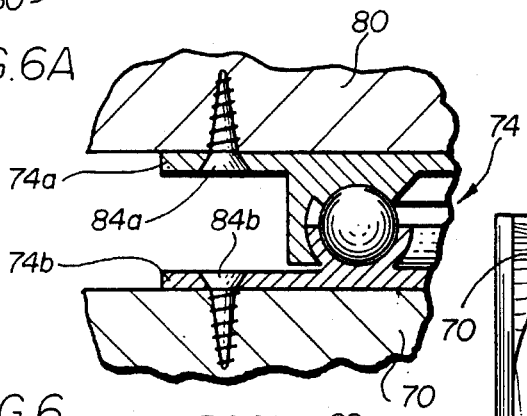
FIG. 6A is an enlarged fragmentary view of the encircled portion of FIG. 6 and showing the interlocked plate components of the turntable and attachment of the turntable to the pedestal of the base cabinet and to the overlying worktop.
Figure 6:
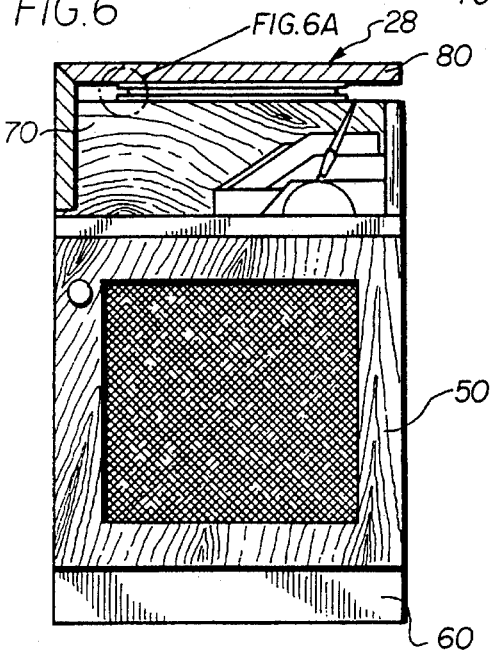
FIG. 6 is a cross-sectional view taken substantially on the lines 6—6 of FIG. 1 and showing the turn table which supports the pivotal top as it overlies the base or desk of the assembly.
Figure 7:
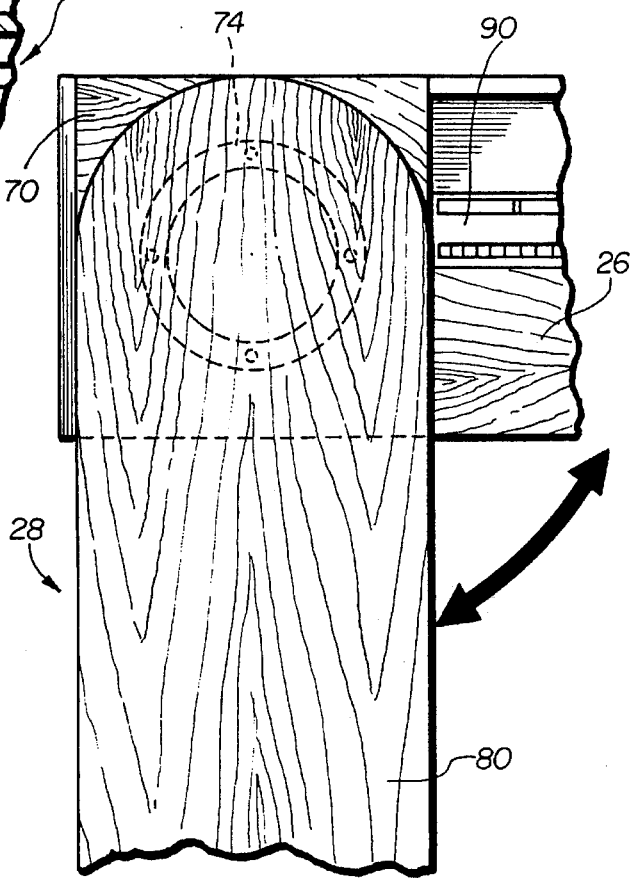
FIG. 7 is a fragmentary top view of the invention and indicating schematically the manner in which the turn-table supported top of the assembly is selectively positioned in place.

As evident in FIGS. 1 and 3, and as seen more clearly in FIGS. 4, 5 and 6, the door-like base or cabinet 24 is formed at one end with a pedestal 70 about 18 inches by 18 inches and about 5 or 6 in height, The useful work surface or top panel 26 of the base cabinet 24 is about 38 inches in width and 18 inches front to rear. Preferably, the height of the cabinet base as measured at the pedestal 70 is about 29 inches. The pedestal 70 itself may house one or more drawers. The back wall 72 of the base cabinet 24 extends to the full height of the pedestal 70.

Firmly mounted on the pedestal 70 is a heavy duty turntable 74 to which the top panel or work top 28 is fastened, in turn. The work top 28 is pivotable, from a rest or stand-by mode shown in FIGS. 1, 2 and 5, clockwise through about 90° of arc to assume an extended, turntables-carried position in which the work top 28 projects horizontally outwardly and normally of a principal horizontal axis of the base or base cabinet 24, as indicated in FIG. 3, As shown, the work top 28 includes a principal board or panel 80 having a curved end portion 82 which overlies the pedestal 70 to which it is secured 84 through the upper plate **74*a* and lower plate 74*b* of the turntable 74 as shown in FIG. 6A. The remainder of the panel 80 overlies and is in congruence with the expanse of the work surface 30 of the desk unit or cabinet 24 but is vertically spaced from or elevated with respect thereto, as shown in FIGS. 3 and 5. In the arrangement described, when the work top 28 is in a "closed" mode and overlies the cabinet 24 along the length thereof, a vertical spacing or clearance of a substantial height of about 6 inches exists between the underside 86 of the panel 28 and the work surface 30 of the base unit 24. This important structural feature of the assembly obviates the need to remove from the work surface 30 of the base cabinet 24 items used at the work station. That is, items such as telephones 90, keyboards, writing equipment 94, calculators 98, terminals, display apparatus as well as other computer equipment may be left in place when the assembly assumes a closed format (FIG. 1 and 2**).

The top panel 28 includes a skirt-like wall 102 along the front, joined to an end skirt 104. The skirts project down so as to reach the top 26 of the base unit 24, as shown in FIGS. 1 and 2. The rear wall 72 of the cabinet 24, which reaches to the full height of the pedestal 70 of the base unit 24, includes a section 108 running from the pedestal 70 to an opposite end of the top 26 of the cabinet 24. The section 108 defines a lineal, elongate wall sector which, when the assembly 20 is "closed" reaches, the underside of undersurface 86 of the pivotal top panel 28. Accordingly, when the top panel 28 is pivoted to a closed mode of the assembly the skirts 102 and 104 of the top 28, in conjunction with the upstanding wall sector 108 of the base unit 24 complete, with the pedestal end wall 112, an enclosure of the spatial zone or chamber located between the top panel 28 and the work surface 30 of the top 26 of the base unit. The structure establishes a clean and visually attractive overall assembly.

The upwardly projecting wall sector 108 of the back wall 78 is formed with through holes or apertures 116 for accommodating electrical supply lines for powering the devices used at the work station and resting on the work top 26 of the assembly.

What is claimed is:

1. A multi-functional combination furniture assembly selectively convertible for facile transformation between a configuration defining a base-like storage cabinet and a configuration defining an L-shaped, desk-like work station, said cabinet having a top work surface, and constituting a housing for a plurality of storage compartments, a pivotal top superimposed on said storage cabinet and providing a second work surface, coupling means securing said pivotal top substantially above and parallel to said top surface of said storage cabinet for pivotal, horizontal rotative displacement with respect thereto, and for swinging said pivotal top about a fixed vertical axis selectively from a closed, first position wherein said top overlies said cabinet, and a cantilevered, open second position in which said top projects outwardly from said, cabinet to expose said top surface of said storage cabinet, spacer means for supporting said pivotal top elevated with respect to and parallel to said work surface of said cabinet for establishing and for maintaining a finite vertical spacing between said pivotal top and said work surface of said cabinet when said pivotal top is in said firs position (a mode to overlie said cabinet), said spacer means for supporting said pivotal top on said storage cabinet including cabinet-mounted pedestal means for supporting said pivotal top thereon in an elevated mode, said coupling means securing said pivotal top to said storage cabinet including a turntable assembly interposed between said pedestal means and said pivotal top, said turntable assembly having a lower pate and an upper plate rotatable with respect to one another, locking means for coupling said lower pate and said upper plate to one another against separation transversely of a plane of rotation thereof, and means for securing said lower plate to said pedestal means, and means for securing said upper pate to said pivotal top, panel-like wall means fixedly secured to and depending normally from said pivotal top when said top is in said second position, and also along an adjacent end of said top for forming skirt-like enclosure walls demarking peripheral boundaries of an elongate chamber between said pivotal top and said work surface of said cabinet when said top is in said first position.

2. The assembly as set forth in claim 1 wherein said top work surface of said cabinet comprises a support for components such as a computer system to be located thereon, and wherein said pivotal top is supported above said top work surface of said cabinet to provide vertical clearance for the components when said pivotal top is in said first position.

3. The assembly as set forth in claim 1 and further comprising means defining a kneehole beneath said pivotal top when said top extends in said second position.

4. The assembly as set forth in claim 1 and further comprising means for defining a plurality of compartments interiorly of said storage cabinet, and means for providing ready access to said compartments.

5. The furniture assembly as set forth in claim 1 wherein with said cabinet in a closed position, said assembly defines an enclosed composite structure.

6. The assembly as set forth in claim 1 and further comprising backstop means fastened to and extending laterally along said cabinet at a rear top edge thereof to project upwardly therealong and normally of said top work surface of said cabinet for providing a mechanical retention wall for components supported on said top work surface and for closing a vertical spatial separation between said top work surface of said cabinet and said pivotal top when said top is in said second position.

7. The assembly as set forth in claim 6 and further comprising through opening means formed in said back stop means for passage of electrical conduits therethrough for delivery of power to components supported on said top surface of said cabinet.

8. In a multifunctional combination furniture assembly selectively convertible for facile transformation between a configuration defining a base-like storage cabinet and a configuration defining an L-shaped, desk-like work station, said cabinet having a top work surface, and constituting a housing for a plurality of storage compartments, a pivotal top superimposed on said storage cabinet and providing a second work surface, coupling means securing said pivotal top substantially above and parallel to said top surface of said storage cabinet for pivotal, horizontal rotative displacement with respect thereto, and for swinging said pivotal top about a fixed vertical axis selectively from a closed first position wherein said top overlies said cabinet, and a cantilevered, open second position in which said top projects outwardly from said cabinet to expose said top surface of said storage cabinet, the improvement comprising spacer means for supporting said pivotal top elevated with respect to and parallel to said work surface of said cabinet for establishing and for maintaining a finite vertical spacing between said pivotal top and said work surface of said cabinet when said pivotal top is in said first position, and panel-like wall means secured to and depending normally from said pivotal top when said top is in said second position, and also along an adjacent end of said top for forming skirt-like enclosure walls terminating at said work surface of said cabinet and demarking peripheral boundaries of an elongate chamber formed between said pivotal top and said work surface of said cabinet when said top is in said first position.

9. The improvement as set forth in claim 8 and further comprising elongate lineal wall means extending upwardly of said top work surface of said cabinet along a rearwardly disposed edge thereof for defining a lineal sector constituting a rear physical boundary of said elongate chamber bounded, at upper and lower limits thereof, by said pivotal top and said work surface of said cabinet when said top is in said first position, and comprising backstop means to prevent articles from falling off said work surface of said cabinet when said top is in said second position.

10. A multi-functional combination furniture assembly selectively convertible for facile transformation between a configuration defining a base-like storage cabinet and a configuration defining an L-shaped, desk-like work station, said cabinet having a top work surface, and constituting a housing for a plurality of storage compartments, a pivotal top superimposed on said storage cabinet and providing a second work surface, coupling means securing said pivotal top substantially above and parallel to said top surface of said storage cabinet for pivotal, horizontal rotative displacement with respect thereto, and for swinging said pivotal top about a fixed vertical axis selectively from a closed, first position wherein said top overlies said cabinet, and a cantilevered, open second position in which said top projects outwardly from said cabinet to expose said top surface of said storage cabinet, spacer means for supporting said pivotal top elevated with respect and parallel to said work surface of said cabinet for establishing and maintaining a finite vertical spacing between said vertical top and said work surface of said cabinet when said pivotal top is in said first position, panel-like wall means fixedly secured to and depending normally from said pivotal top when said top is in said second position, and also along an adjacent end of said top for forming skirt-like enclosure walls terminating at said work surface of said cabinet and demarking peripheral boundaries of an elongate chamber formed between said pivotal top and said work surface of said cabinet when said top is in said first position.

* * * * *